United States Patent [19]

Doll

[11] Patent Number: 4,466,198

[45] Date of Patent: Aug. 21, 1984

[54] APPARATUS AND METHOD FOR DRYING LUMBER

[76] Inventor: Brendan L. Doll, 319 Appalachian Dr., Boone, N.C. 28607

[21] Appl. No.: 472,846

[22] Filed: Mar. 7, 1983

[51] Int. Cl.[3] ..... F26B 3/34

[52] U.S. Cl. ..... 34/1; 34/68; 34/92; 34/73

[58] Field of Search ..... 34/1, 68, 9.5, 13.4, 34/13.8, 16.5, 92, 73, 78; 219/10.55 M, 10.55 R, 10.61 R, 10.81

[56] References Cited

U.S. PATENT DOCUMENTS

| | | | |
|---|---|---|---|
| 2,617,202 | 11/1952 | Reedy | 34/13.8 |
| 3,986,268 | 10/1976 | Koppelman | 34/1 |
| 4,176,464 | 12/1979 | Randolph | 34/16.5 |
| 4,194,296 | 3/1980 | Pagnozzi et al. | 34/16.5 |
| 4,258,240 | 3/1981 | Pless | 34/16.5 |

*Primary Examiner*—Larry I. Schwartz

*Attorney, Agent, or Firm*—Bell, Seltzer, Park & Gibson

[57] ABSTRACT

The stack of lumber is first enclosed in a flexible covering of pervious sheet material and then enclosed in a flexible covering of impervious sheet material and electrode plates are positioned above and below the stack of lumber. A subatmospheric pressure is applied on the stack of lumber and the electrodes are charged by high-frequency electric current to dielectrically heat the lumber and volatized water vapors are extracted from the stack of lumber and condensed and withdrawn to reduce the moisture content of the stack of lumber to the desired degree, 15 percent or less by weight. Accurate drying of the lumber is provided and the drying operation requires a relatively short period of time.

13 Claims, 5 Drawing Figures

APPARATUS AND METHOD FOR DRYING LUMBER

FIELD OF THE INVENTION

This invention relates generally to an apparatus and method for drying lumber and more particularly to an apparatus and method for drying lumber by the use of dielectric heating while maintaining the lumber under subatmospheric pressure.

BACKGROUND OF THE INVENTION

In many industries, such as the furniture industry, it is essential that the moisture content of the lumber or wood be accurately controlled. The drying or seasoning of lumber is usually accomplished by placing the lumber in a kiln in which hot air is circulated around the lumber and the wet and dry bulb temperatures of the circulating air are closely controlled to achieve the desired amount of moisture reduction in the lumber. Despite the fact that kiln drying of lumber requires a considerable length of time, this system of drying or seasoning the lumber is still in widespread use.

For a number of years there have been several proposals for drying or seasoning of lumber by dielectric heat in order to reduce the time required for drying the lumber. In certain instances, such as disclosed in U.S. Pat. Nos. 2,543,618 and 3,721,013, it has been proposed that the initial drying of the lumber be carried out in a kiln and that the lumber be dielectrically heated during the final stages of the drying or seasoning operation. While the cost of drying lumber is reduced by the combination of kiln and dielectric drying disclosed in these patents, the cost of the equipment is high and the most economical drying of the lumber is not achieved. A massive kiln housing must be provided to dry lumber in accordance with each of these patents. The lumber is stacked on a kiln truck and rolled into and out of the kiln housing on rails so that the drying apparatus is not easily moved from one location to another.

U.S. Pat. No. 2,387,595 discloses the drying of a single wood bowling pin by encasing the bowling pin in a sheath of rubberized material, applying subatmospheric pressure to the bowling pin and dielectrically heating the bowling pin to reduce the moisture content thereof. The moisture is withdrawn from the bowling pin in a direction which is parallel to the direction of the grain of the wood or longitudinally of the length of the bowling pin. The drying of a single bowling pin substantially increases the cost and limits the application of the apparatus and method disclosed in this patent to a very limited field. The sheath of rubberized material in direct contact with the wood tends to trap moisture on the outer surface and prevents the uniform drying of the wood.

It has also been proposed to decrease the time required in the drying or seasoning of lumber by placing a stack of lumber in a suitable pressure vessel and subjecting the stack of lumber to subatmospheric pressure while dielectrically heating the lumber. For example, an apparatus and method of this type is disclosed in U.S. Pat. No. 3,986,268. However, the cost of providing a pressure vessel suitable for the reception of the stacks of lumber is very expensive and therefore discourages widespread use of this type of method for drying lumber. Also, the weight and size of the pressure vessel prevents easy movement of the pressure vessel from one location to another.

SUMMARY OF THE INVENTION

With the foregoing in mind, it is an object of the present invention to provide an apparatus and method for economically drying lumber in a short period of time. The present apparatus utilizes the combination of subatmospheric pressure and dielectric heating techniques and is of a relatively light weight construction so that it may be easily moved from one location to another.

The lumber drying apparatus of the present invention includes a first rectangular electrode plate positioned above and covering the stack of lumber with a second electrode plate positioned beneath and supporting the stack of lumber thereon. The second electrode plate is provided with spaced openings to permit the passage of moisture therethrough and a moisture and water collecting chamber extends beneath the second electrode plate. An impervious covering, such as sheet film material, surrounds the top, sides and ends of the stack of lumber and is suitably sealed to the peripheral edge of the second electrode plate. A covering of pervious sheet material, such as a plastic mesh, surrounds the stack of lumber and provides a pervious layer between the outer surface of the lumber stack and the impervious film covering surrounding the top, sides and ends of the stack of lumber so as to provide a passageway for removal of moisture and water extracted from the stack of lumber by the vacuum and dielectric heat. A high-frequency oscillator is connected to the first and second electrode plates for dielectrically heating the stack of lumber and driving moisture and water therefrom while a vacuum-producing pump is connected with the interior of the impervious covering for providing subatmospheric pressure within the sheet film covering and for aiding in the removal of moisture from the stack of lumber.

The method of drying lumber in accordance with the present invention permits the lowering of the moisture content of the lumber from above 75 percent to less than 15 percent by weight and permits the entire drying operation to be carried out in a relatively short period of time of about 48 to 72 hours. The subatmospheric pressure applied to the stack of lumber covered with the flexible pervious sheet material and the impervious flexible covering of sheet material is about 15 to 25 millimeters of mercury while the lumber is subjected to a temperature of from about 100° to 200° F. About 1 to 15 megacycles of high-frequency electric current is applied across the stack of lumber by charging the electrode plates maintained on opposite sides thereof. Moisture and water vapors are extracted from the stack of lumber by the subatmospheric pressure and dielectric heating steps and the water vapors are condensed and the water withdrawn during the drying process.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 3:
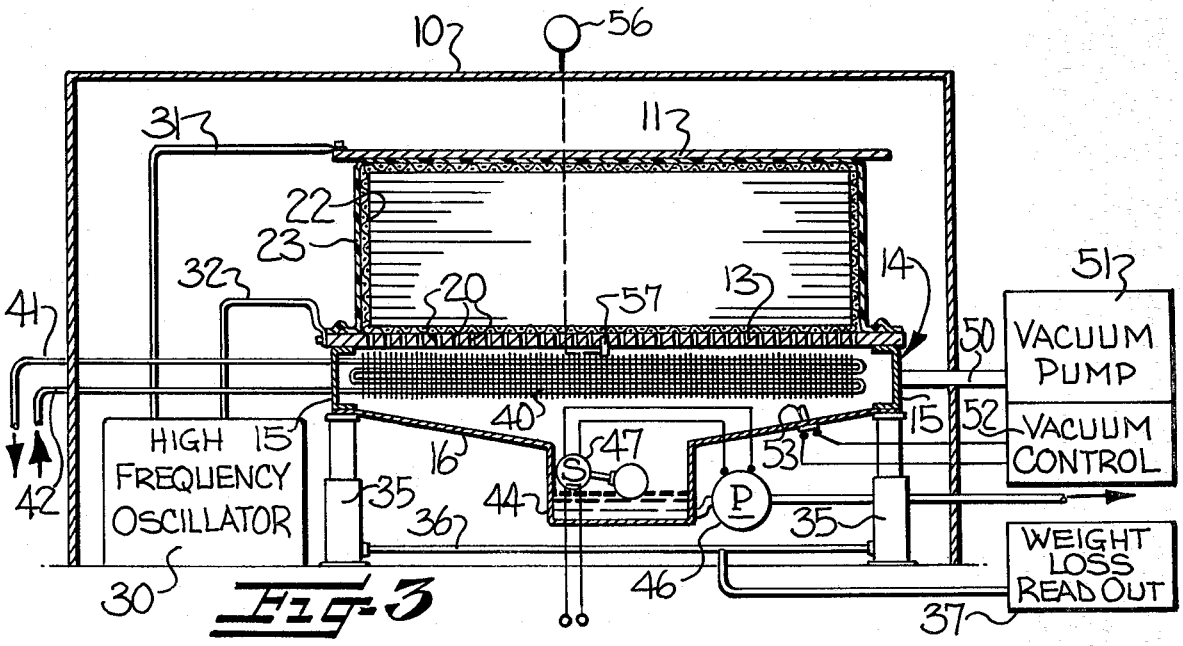
FIG. 3 is a transverse vertical sectional view taken substantially along the line 3—3 in FIG. 1.
Figure 4:
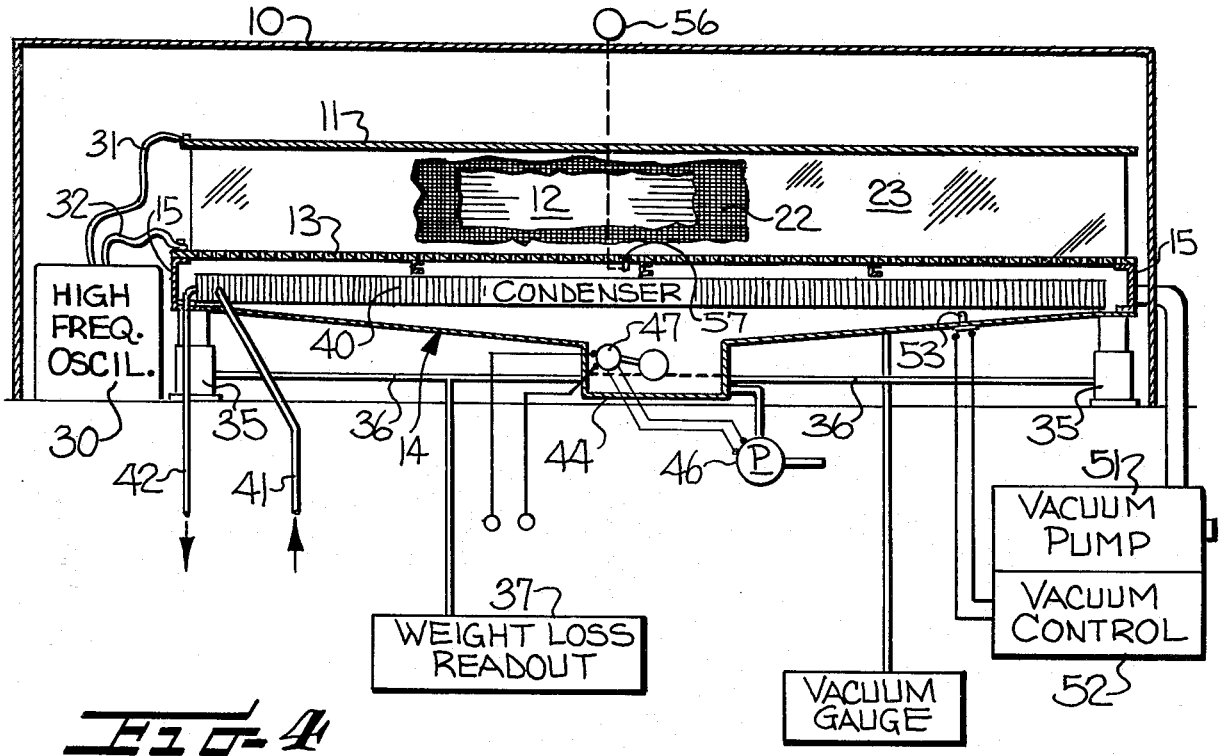
FIG. 4 is a longitudinal vertical sectional view taken substantially along the line 4—4 in FIG. 1.

As illustrated in the drawings, a suitable shielding, such as a wire mesh screen housing 10, surrounds the lumber drying apparatus and provides a radiation shielding to prevent interference with established radio communication channels and the like when the apparatus is in operation. A first or upper rectangular electrode plate 11 is positioned above and covers the stack of lumber, indicated at 12. A second or lower electrode plate 13 is positioned beneath and supports the stack of lumber 12 thereon. The second electrode 13 extends outwardly beyond the sides and ends of the stack of lumber 12 a distance of about three or four inches, for purposes to be presently described. The second electrode plate 13 forms the upper surface of a base assembly, broadly indicated at 14. The base assembly 14 includes side and end channels 15 (FIGS. 3 and 4) and a lower housing plate 16 which slopes downwardly and inwardly from opposite sides and ends of the base assembly 14 (FIGS. 3 and 4).

Figure 5:
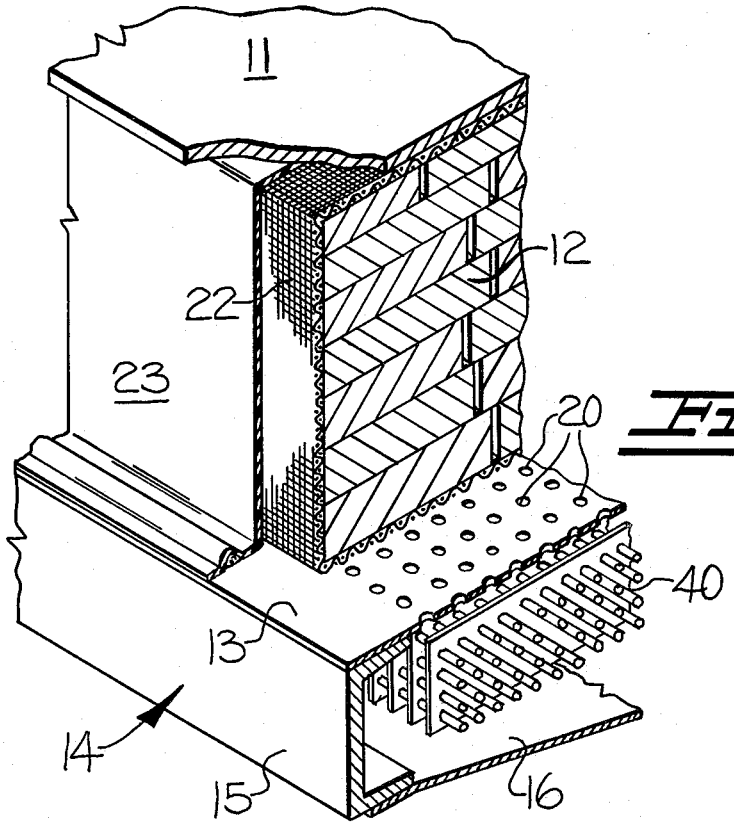
FIG. 5 is an enlarged fragmentary isometric view of a portion of the apparatus, illustrating the position of the stacked lumber during the drying process.

The second electrode plate 13 is provided with spaced openings 20 (FIG. 5) to permit the passage of moisture and water vapor therethrough. The side and end channels 15 and the lower housing plate 16 form moisture-condensing and water-collecting chamber means extending beneath and communicating with the openings 20 in the second electrode plate 13, for purposes to be presently described.

Figure 2:
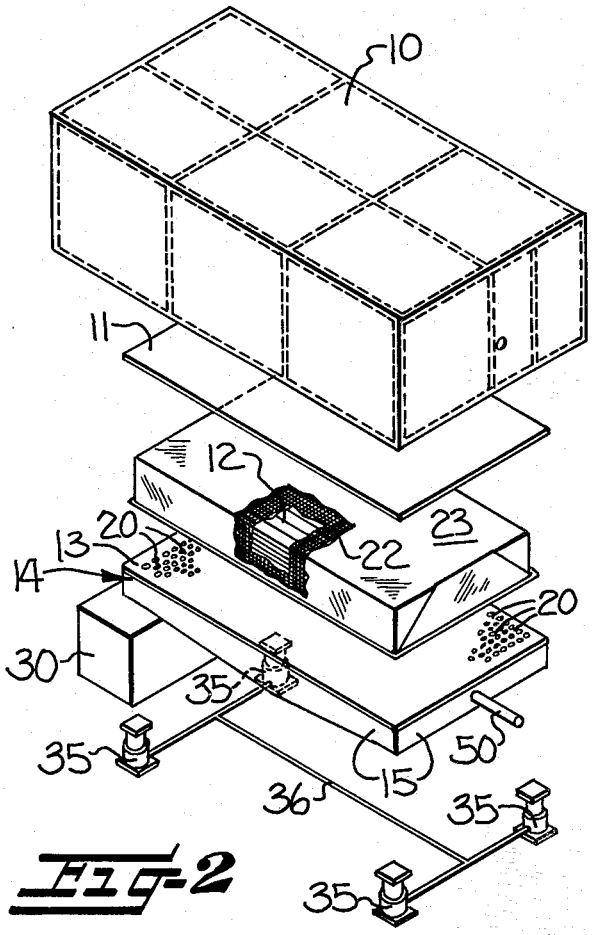
FIG. 2 is a view similar to FIG. 1 but showing the various components of the wood drying apparatus in exploded condition.

A flexible covering of pervious sheet material, such as a loosely woven, nonelectrically conductive plastic mesh material 22, extends completely around and encloses all sides of the stack of lumber 12. An impervious covering of flexible sheet material, such as polyvinyl chloride film 23, encloses at least the major portion of the stack of lumber 12. As illustrated in FIGS. 2, 3 and 4, the impervious film material 23 extends over the top, ends and sides of the stack of lumber 12 and is folded outwardly and sealed to the peripheral edge portions of the upper surface of the second electrode 13, in the manner illustrated in FIG. 5.

High-frequency generating means, in the form of a high-frequency oscillator 30 is connected by respective connectors 31, 32 to the first and second electrodes 11, 13. The high-frequency oscillator 30 is adapted to apply high-frequency electric current across the stack of lumber 12 by charging the electrodes 11, 13 to dielectrically heat the stack of lumber and drive moisture and water vapor therefrom. Each corner of the lower base assembly 14 is supported by an insulating support 35 which is provided with a conventional type of load cell for measuring the loss of weight during the drying process. Lines 36 interconnect the insulating supports 35 at each corner of the assembly 14 and are connected to a suitable weight loss readout device 37 (FIGS. 3 and 4).

A condenser coil 40 is supported beneath the lower electrode 13 and an inlet line 41 is provided to supply cool water to the condenser 40 and an outlet line 42 is provided to remove water from the condenser 40. The lower portion of the base assembly 14 is provided with a depressed sump 44 in which the condensed water is collected. A liquid pump 46 is connected to the sump 44 and the operation of the pump 46 is controlled by a float-type switch 47 so that the water in the sump 44 is removed as it accumulates above a predetermined level.

A suction or vacuum line 50 is connected at one end to the collection chamber in the base assembly 14 and the other end is connected to a suitable vacuum pump 51 provided with a vacuum control 52 including a vacuum indicator 53 positioned within the chamber in the base assembly 14. In operation, the vacuum control 52 may be set to operate the vacuum pump 51 so that a predetermined subatmospheric pressure can be maintained on the stack of lumber 12 since the openings 20 in the lower electrode plate 13 provide communication between the vacuum pump 51 and the stack of lumber 12. A vacuum gauge 55 is connected to the collection chamber in the base assembly 14 to provide a visual indication to the operator of the amount of subatmospheric pressure which is being maintained on the stack of lumber 12. A temperature gauge 56 is connected to a temperature sensor 57 (FIG. 3) for providing a visual indication of the temperature of the stack of lumber.

METHOD OF OPERATION

Many factors determine the particular type of treatment to be applied to the stack of lumber to obtain the desired amount of drying or seasoning of the lumber so that the moisture content is reduced to the desired amount. For example, the type of treatment will vary, depending upon the type of lumber to be dried, the thickness of the lumber and the total amount of lumber to be dried at one time. The moisture content remaining in the lumber is determined, at least to some degree, by the end use to which the lumber is to be placed. In furniture manufacture, it is desirable to leave more moisture in the lumber to be used in manufacturing drawers so that the drawers will have a tendency to shrink and there will be less likelihood of sticking. On the other hand, the lumber used for the rungs of chairs is usually dried to a greater degree so that the rungs will have a tendency to swell or expand in use and become tighter in the legs of the chair.

The apparatus illustrated in the drawings is suitable for treating a stack of lumber approximately eight feet wide, twelve feet long and thirty inches high (approximately 3,000 board feet of lumber). Green lumber may have from about 200 percent to 75 percent moisture content by weight and the drying apparatus and method of the present invention is adapted to reduce this moisture content to about 15 percent or less by weight, preferably about 5 percent for lumber to be used in the furniture industry. As pointed out above, the treatment will vary depending upon many factors, but it is believed to be helpful in understanding the invention to generally set forth the treatment steps utilized in drying a fairly wide variety of types of lumber.

The stack of lumber 12 is first wrapped and enclosed on all sides with a flexible covering of pervious sheet material, such as the plastic mesh, nonconductive material 22. The wrapped stack of lumber is then placed on the second or lower electrode 13 and at least the major portion of the stack of lumber is covered with an impervious covering of sheet material, such as a polyvinyl chloride film 23. As will be noted in the drawings, the impervious film 23 covers the top, sides and end of the stack of lumber 12 and the lower edge thereof extends along and is sealed against the outer peripheral edge portion of the electrode plate 13. When the lumber stack has been covered by the film 23, the vacuum pump may be started and the vacuum gauge 55 observed to determine if there are any leaks around the outer edge of the film 23 and if so, these leaks may be corrected before the upper electrode 11 is positioned above the stack of lumber 12.

Figure 1:
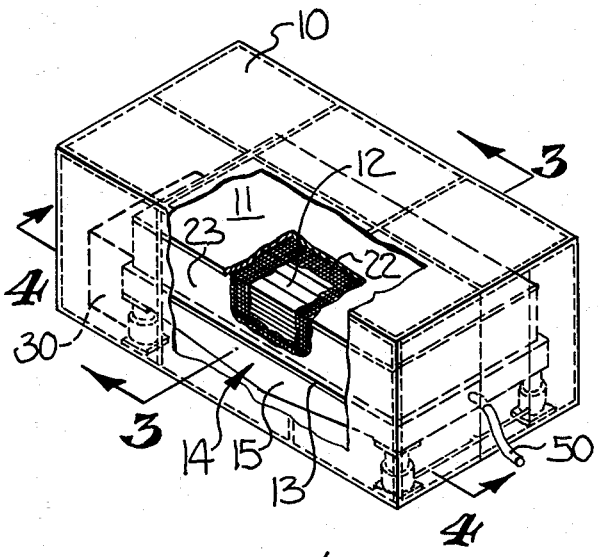
FIG. 1 is an isometric view of the wood drying apparatus of the present invention.

The upper electrode 11 is then placed above the stack of lumber 12 and the shielding screen housing 10 is positioned around the stack of lumber, as illustrated in FIG. 1. A subatmospheric pressure of about 15 to 25 millimeters of mercury is imposed on the stack of lumber 12 by the vacuum pump 51. The high-frequency oscillator 30 is then turned on to apply from about 1 to 15 megacycles (megahertz) of high-frequency electric current across the stack of lumber as the electrodes 11 and 13 are charged. The high-frequency oscillator 30 may be varied to maintain the temperature in the stack of lumber 12 from about 100 degrees to 200 degrees F. As the dielectric heating of the lumber stack continues, the moisture in the lumber is heated and water vapor is extracted from the wood by means of the dielectric heating and subatmospheric pressure and the expelled water vapor is drawn downwardly through the openings 20 in the electrode 13. The water vapor contacts the condenser coil 40 and the water condensed from the water vapor drains into the sump 44 where it is withdrawn by the pump 46, under control of the float switch 47.

During the drying operation, the weight loss is constantly monitored to determine if the process is being carried out at the proper rate, and to determine when the proper amount of moisture content remains in the lumber being treated. Most types of lumber have been found to require a period of from about 48 to 72 hours to complete the drying so that the moisture content is 15 percent or less by weight.

The pervious covering 22 around the lumber stack prevents direct contact of the impervious cover 23 with the lumber and provides a passageway for the easy removal of evaporated moisture from the lumber stack 12. The pervious covering 22 also provides a cushion or resilient seat for the impervious film 23 and avoids damaging the film since it covers the rough and uneven areas, especially around the opposite ends of the lumber. It has been found that a coarsely woven cloth of monofilament plastic is very suitable for use as the pervious wrapping 22.

After completion of the drying cycle, the high-frequency oscillator 30 is turned off and the vacuum pump 51 ceases to operate so that the area surrounding the lumber stack 12 returns to the normal atmospheric pressure. The screen shield housing 10 is then removed along with the upper electrode 11. The impervious film 13 and the pervious covering 22 are then removed and the dried lumber stack 12 can be unloaded so that the apparatus is then ready for the next lumber stack for drying. The present apparatus and method of drying lumber can be economically constructed and is operable at an economical cost. The apparatus is constructed so that it can be easily moved to various locations and is accurately controlled to dry the lumber to the desired moisture content in a relatively short length of time.

While the drying operation is described as being carried out at a subatmospheric pressure of about 15 to 25 millimeters of mercury and at a temperature of from about 100° to 200° F., it is to be understood that considerable drying may be accomplished, apparently at less cost, at subatmospheric pressures as high as 150 millimeters of mercury and with corresponding increases in temperature. The use of the higher pressure and temperature may cause degrading of certain types of lumber but will not degrade other types of lumber. In any event, the present apparatus and method work extremely well under both relatively low and relatively high pressures and temperatures.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A method of drying a stack of lumber comprising the steps of (a) enclosing at least a major portion of the stack of lumber in a flexible covering of impervious sheet material, (b) positioning a first electrode plate against the outside of the flexible covering and at one side of the stack of lumber, (c) positioning a second electrode plate at the other side of the stack of lumber, the peripheral edge of the second electrode plate being sealingly connected to the flexible covering and including spaced openings to permit the passage of water vapor and water therethrough, (d) imposing a subatmospheric pressure within the impervoius covering and on the stack of lumber, (e) applying high-frequency electric current across the stack of lumber by charging the electrode plates maintained on opposite sides of the stack of lumber to dielectrically heat the stack of lumber, (f) withdrawing volatized water vapors extracted from the stack of lumber through the openings in the second electrode plate by means of the subatmospheric pressure and the dielectric heating steps, (g) condensing the water vapor and withdrawing the water condensed from the water vapor, and (h) continuing steps (b) through (e) until the stack of lumber is dried sufficiently to contain the desired moisture content.

2. A method according to claim 1 including the step of enclosing the stack of lumber in a flexible covering of pervious sheet material before applying the flexible covering of impervious sheet material thereto.

3. A method according to claim 1 wherein the stack of lumber initially has a moisture content above 75% and is dried to a moisture content of 15% or less by weight.

4. A method according to claim 1 wherein a subatmospheric pressure is imposed on the stack of lumber of about 15 to 25 millimeters of mercury, and wherein a high-frequency electric current of from about 1 to 15 megacycles is applied across the stack of lumber to maintain the temperature in the stack of lumber from about 100° F. to 200° F.

5. An apparatus for drying a substantially rectangular stack of green lumber and comprising (a) a first rectangular electrode plate adapted to be positioned above and covering the stack of lumber, (b) a second electrode plate adapted to be positioned beneath and to support the stack of lumber thereon, said second electrode plate being provided with spaced openings to permit the passage of water vapor and water therethrough, (c) water vapor and water collecting chamber means extending beneath and communicating with said opening in said second electrode plate, (d) an impervious covering of sheet material adapted to surround the top, sides and ends of the stack of lumber and extending beneath said first electrode plate, said impervious covering being sealably connected to the peripheral edge of said second electrode plate, (e) hight-frequency generating means connected to said first and second electrode plates for internally heating the stack of lumber and driving moisture and water vapor therefrom, and (f) vacuum-producing means communicatively connected with the interior of said impervious covering of sheet material for producing subatmospheric pressure within said impervious cover and aiding in the removal of moisture from the stack of lumber.

6. An apparatus according to claim 5 including a pervious covering of sheet material adapted to completely enclose the stack of lumber and extending beneath said impervious covering of sheet material and preventing direct contact of said impervious covering of sheet material with the stack of lumber to provide a passageway for enhancing the removal of moisture from the stack of lumber.

7. An apparatus according to claim 6 wherein said pervious covering of sheet material comprises loosely woven nonelectrically conductive mesh material.

8. An apparatus according to claim 5 wherein said impervious covering of sheet material comprises polyvinyl chloride film.

9. An apparatus according to claim 5 including condenser means positioned in said water vapor and water collecting chamber means for converting water vapor removed from the stack of lumber to liquid.

10. An apparatus according to claim 5 including pump means operatively connected to said water vapor and water collecting chamber means for removing water collected therein.

11. An apparatus according to claim 10 including float control means positioned in said water vapor and water collecting chamber means and being operable to actuate said pump means upon accumulation of a predetermined amount of water in said water vapor and water collecting chamber means.

12. An apparatus according to claim 5 including weight indicating support means supporting said apparatus and being operable to indicate the weight of the lumber during various stages of the removal of the moisture therefrom.

13. An apparatus according to claim 5 wherein said vacuum producing means is connected to said water vapor and water collecting chamber means so that the subatmospheric pressure is produced within said impervious cover through said openings in said second electrode plate.

* * * * *